US006677843B1

(12) United States Patent
Monroe et al.

(10) Patent No.: US 6,677,843 B1
(45) Date of Patent: Jan. 13, 2004

(54) MAGNETICALLY COUPLED PUSHBUTTON PLUNGER SWITCH

(75) Inventors: Dennis Monroe, Phoenix, AZ (US); Anthony J. Van Zeeland, Mesa, AZ (US)

(73) Assignee: DataHand Systems, Inc., Phoenix, AZ (US)

( * ) Notice: Subject to any disclaimer, the term of this patent is extended or adjusted under 35 U.S.C. 154(b) by 0 days.

(21) Appl. No.: 10/456,146

(22) Filed: Jun. 6, 2003

(51) Int. Cl.[7] ..... H01H 9/00
(52) U.S. Cl. ..... 335/205; 200/521; 200/512
(58) Field of Search ..... 335/205–208; 200/512, 520–522

(56) References Cited

U.S. PATENT DOCUMENTS 4,463,234 A * 7/1984 Bennewitz ..... 200/516
5,228,561 A * 7/1993 Schroeder et al. ..... 200/51
5,389,757 A * 2/1995 Souliere ..... 200/345
5,523,730 A * 6/1996 Van Zeeland ..... 335/205
5,867,082 A * 2/1999 Van Zeeland ..... 335/205
5,990,772 A * 11/1999 Van Zeeland ..... 335/207
6,400,246 B1 * 6/2002 Hill et al. ..... 335/205
6,556,112 B1 * 4/2003 Van Zeeland et al. ..... 335/205

* cited by examiner

*Primary Examiner*—Tuyen T. Nguyen
(74) *Attorney, Agent, or Firm*—Scott A. Hill

(57) ABSTRACT

A magnetically coupled pushbutton plunger switch is discrete and may be used with a keyboard. A post attached to magnetic armature is normally magnetically held in coupled engagement with a magnetic coupler attached to a base. The post passes through the lumen of a sleeve attached to the base such that the post, when moved up and down through the lumen, causes the magnetic armature to move in and out of the coupled engagement with the magnetic coupler. The head of a fastener used to secure the magnetic armature to the post is used in a unique way to actuate a membrane switch assembly held in spaced relation to the base. The fastener head protrudes from the bottom of the magnetic armature so that the fastener head, when the magnetic armature is forced out of coupled engagement with the magnetic coupler, physically contacts the membrane switch assembly to close electrical conductors.

20 Claims, 2 Drawing Sheets

MAGNETICALLY COUPLED PUSHBUTTON PLUNGER SWITCH

BACKGROUND OF THE INVENTION

Magnetically coupled pushbutton switches are commonly used with short travel keypads and keyboards. They provide good tactile feedback to a user, are compact, discrete, and have a long life. These switches, exemplified in FIGS. 1–4, normally have an electrically conductive armature 2 that is magnetically held by a coupler magnet layer 4 in a rest position, as in FIG. 1, spaced from switch contacts 6 on a non-conductive substrate layer 8. A user-provided actuation force applied to a crown 10 of the electrically conductive armature (usually stamped sheet metal that is silver plated) causes it to snap free of the coupler magnet layer and close the switch contacts by electrically connecting them. Release of the actuation force allows the coupler magnet layer to attract the electrically conductive armature back to the rest position to reopen the switch A nonconductive spacer layer 12 (such as high density foam) is fixed to the substrate layer, with a cavity 14 in the spacer layer exposing the switch contacts. The coupler magnet layer overlies the spacer layer. The electrically conductive armature is magnetically coupled to the bottom of the coupler magnet layer so that the electrically conductive armature is housed within the cavity in the spacer layer. The armature's crown protrudes through an aperture 16 in the coupler magnet layer. Typically, a polyester membrane layer 18 with suitable graphics overlies the coupler magnet layer to seal the switch and to direct a user of the switch as to location and function of the switch Magnetically coupled pushbutton switches of the prior art, as shown and described in U.S. Pat. Nos. 5,523,730, 5,990,772, 6,262,646, 6,466,118 and 6,556,112, all have an electrically conductive armature that can travel through a unique pivot/click (FIG. 2/FIG. 3) movement designed to create a very distinct tactile feedback to a switch user. This distinct tactile feedback, inherent to the design, is necessary for the proper function of the switch because the electrically conductive armature 2 is responsible for electrically connecting the exposed switch contacts 6 on the substrate layer 8 of the switch FIG. 2 shows that application of an actuation force 20 causes a heel 22 of the electrically conductive armature to break away from the coupler magnet layer 4 and travel to the substrate layer 8 where the heel stops and functions as a fulcrum for the electrically conductive armature. FIG. 3 shows that continued application of the actuation force causes a toe 26 of the electrically conductive armature to abruptly break away from the coupler magnet layer so that the toe contacts the substrate layer and the electrically conductive armature electrically shorts the switch contacts formed on the substrate, thereby actuating the switch

SUMMARY OF THE INVENTION

The present invention is a magnetically coupled pushbutton plunger switch that is discrete and may be used with a keyboard, or anyplace there is limited space. There are several unique characteristics of the present invention that are, for some applications, more preferable than the prior art. A first benefit of the present invention is the ability to seal the electrical conductors of the switch without the use of a polyester membrane overlay that can add undesired pre-load and prevents the use of hard keycaps. A second benefit of the present invention is that the armature does not need to be electrically conductive, or silver-plated, because the armature is not a part of an electrical circuit, unlike the prior art A third benefit of the present invention is that the pivot/click motion has been eliminated, so there is no double tactile feedback to a switch user.

In the preferred embodiment of the present invention, a post attached perpendicularly to a keycap is moveably mounted inside a sleeve attached perpendicularly to a base such that the hard keycap and base lie in substantially parallel planes. A magnetic coupler, fixed to the bottom surface of the base, magnetically attracts a magnetic armature that is secured to the bottom end of the post. When a user-provided actuation force is applied to the top of the hard keycap, the magnetic armature evenly breaks away from the magnetic coupler in one motion, similar to the way that a suction cup abruptly breaks away from a smooth surface when pulled perpendicular to the surface. After the magnetic armature breaks away from the magnetic coupler, it travels into physical contact with a sealed membrane switch assembly. Contact with the membrane switch assembly causes opposing electrical conductors to electrically connect, thereby closing the switch. As used herein, the term "top" refers to that surface of any part in a cross sectional figure of the drawings that faces the top edge of the page, while "bottom" refers to that surface of any part in a cross sectional figure of the drawings that faces the bottom edge of the page.

DETAILED DESCRIPTION OF THE INVENTION

Figure 1:
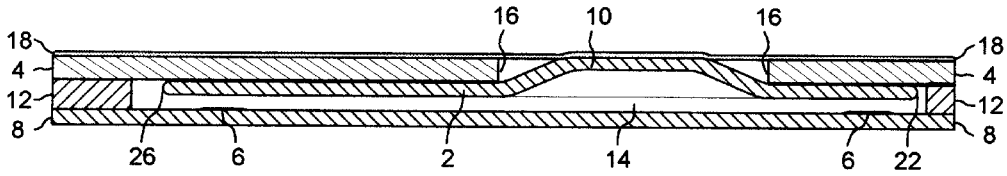
Fig. 1 Prior Art
FIG. 1 is a crossection of a prior art magnetically coupled pushbutton switch in the rest position.
Figure 2:
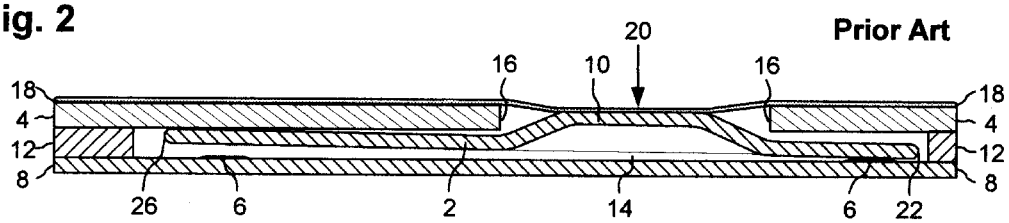
Fig. 2 Prior Art
FIG. 2 is a crossection of the switch of FIG. 1 in a partially actuated position, with the heel of the armature acting as a fulcrum.
Figure 3:
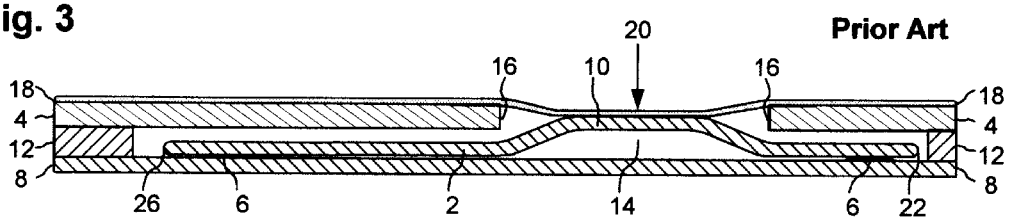
Fig. 3 Prior Art
FIG. 3 is a crossection of the switch of FIG. 1 in the fully actuated position.
Figure 4:
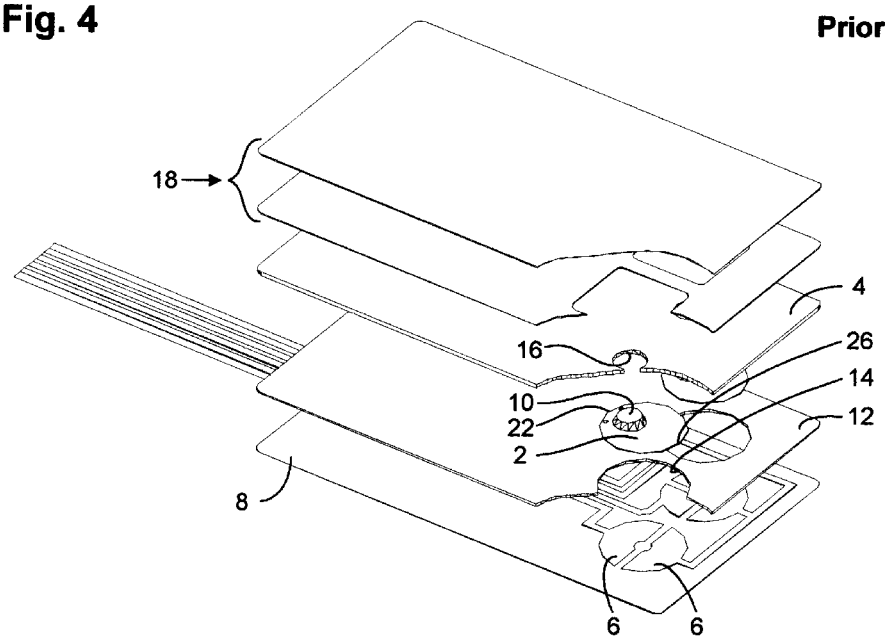
Fig. 4 Prior Art
FIG. 4 is an exploded perspective view of a prior art magnetically coupled pushbutton switch.
Figure 5:
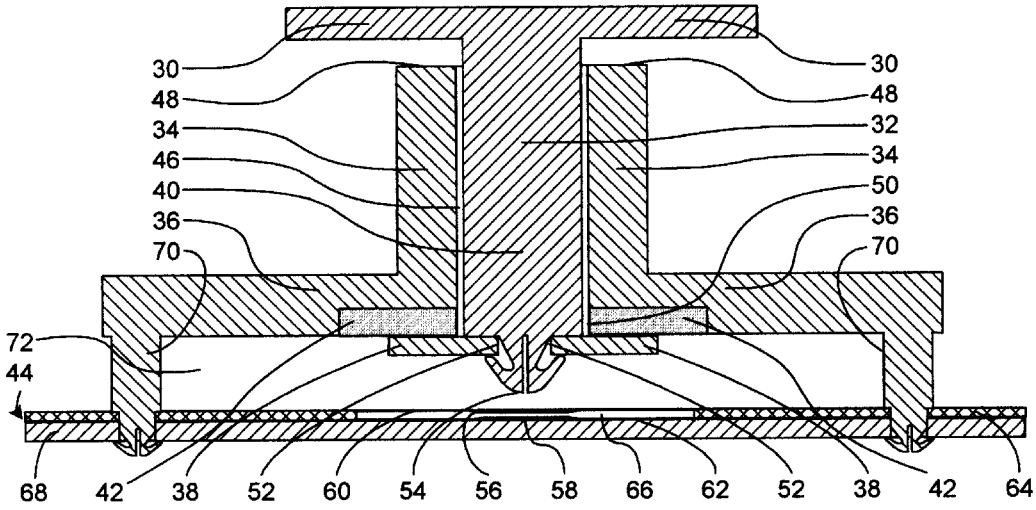
FIG. 5 is a cross section of a magnetically coupled pushbutton plunger switch of the present invention in the rest position.
Figure 6:
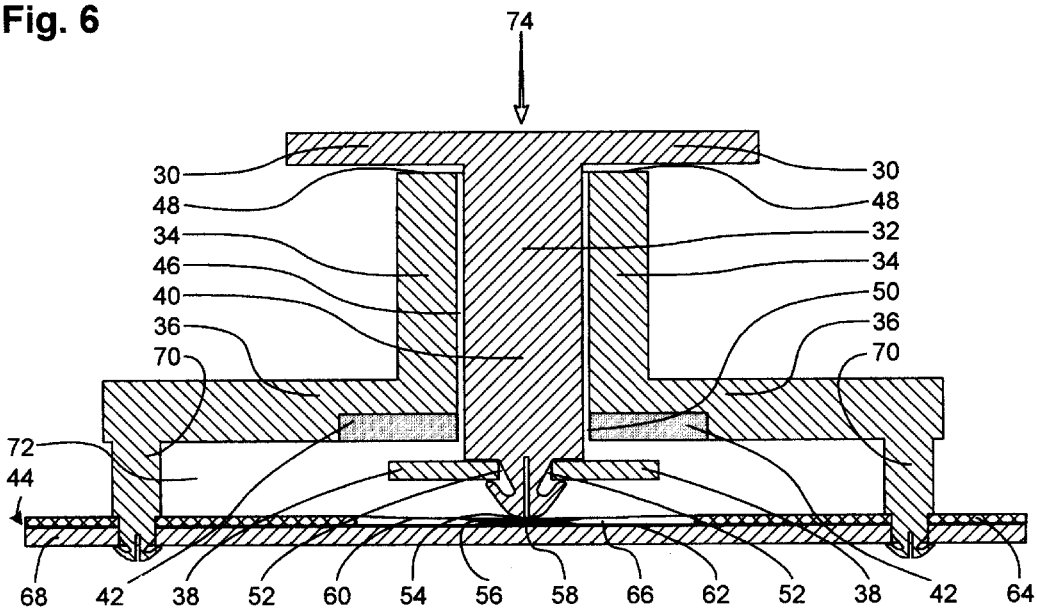
FIG. 6 is a crossection of the switch of FIG. 5 in the fully actuated position.

As shown in FIGS. 5 and 6, the preferred embodiment of the magnetically coupled pushbutton plunger switch of the present invention utilizes, from the top down, a hard keycap 30 attached to a post 32, a sleeve 34 attached to a base 36, a magnetic armature 38 attached to the bottom of the post with a fastener 40, a magnetic coupler 42, and a membrane switch assembly 44. There are several additional features shown and described in the foregoing description that, though preferred, may be modified or excluded where cost or preference dictates otherwise. Because of the symmetry of the preferred embodiment, cross-sections through a center height of the switch, like the ones shown, all look substantially the same. Preferred materials, shapes, methods of attachment and methods of assembly will be discussed, but these preferences are not intended to exclude suitable or functionally equivalent alternatives.

The hard keycap 30 preferably has a substantially flat top surface that is centrally located over the top end of the post 32. The plane of the top surface of the hard keycap is substantially perpendicular to the length of the post. If desired, the top surface of the hard keycap may be slightly concave or convex. Also, the top surface of the hard keycap may include a center pip. A center pip is a small raised structure, like the bumps on the "F" and "J" keys of many QWERTY keyboards. Ideally, the hard keycap and post are molded as a single piece part from a material such as nylon or acetal, but there are numerous other rigid materials, such as metal or plastic, that may also be used to make the hard keycap and post. Where appropriate, the hard keycap and post may be stamped, machined, or otherwise formed.

The shape of the top surface of the hard keycap 30 is preferably round, and a crossection of the post 32, perpendicular to its length, is also preferably round. The resulting symmetry lessens the likelihood that the post will bind inside the sleeve 34. Additionally, if there is a rotation of the post, the hard keycap will remain aligned. If another shape is used for the top surface of the hard keycap, such as the familiar rectangular keycap shape on many keyboards, the post should additionally have a structure or shape that prevents rotation of the post inside the sleeve. Symmetry is, however, preferred because a round post has few potential alignment problems, thereby lowering assembly costs. For keyboard applications, the preferred size of the post is about a 5 mm diameter with about a 10 mm length, and the preferred size of the hard keycap is about a 15 mm diameter disc that is about 1 mm thick.

The sleeve 34 that is attached to the base 36 accepts the post 32 such that the post can easily slide up and down within a lumen 46 of the sleeve with minimal friction, while any side to side movement of the post within the lumen is preferably not noticeable to a user. The diameter of the lumen should be roughly ten percent greater than the outside diameter of the post, but materials and overall size of the magnetically coupled pushbutton plunger switch should be taken into consideration. The outside diameter of the sleeve, thickness of the base, and overall size of the base are not particularly important so long as the sleeve and base are strong and there is no excess material that interferes with switch operation. There is also a keycap stop 48, a substantially flat surface on the top of the sleeve that is in a plane perpendicular to the sleeve's length, that limits the downward travel of the post. The keycap stop prevents damage to the membrane switch assembly 44 in the event that a user applies excessive force to the hard keycap 30. As with the hard keycap and post, the sleeve and base are preferably molded as a single piece part from a material such as nylon, acetal or other rigid material, but may be stamped, machined or otherwise formed.

The magnetic coupler 42 is fixed to the bottom surface of the base 36. The preferred method is to insert mold the base to the magnetic coupler, but other methods, such as adhesively fixing the magnetic coupler to the base, may alternatively be used. The magnetic coupler is preferably disc shaped and has an aperture 50 that is as large, or slightly larger, than the lumen 46. The aperture should act as an extension of the lumen, and the post 32 should be able to freely travel up and down through the lumen and aperture. Preferably, the magnetic coupler is extruded, calendar or molded magnet that has a uniform thickness and has a substantially flat bottom surface. Barium ferrite bonded sheet magnet is currently the cheapest material that is suitable for making a magnetic coupler. Extruded or calendar sheet magnet may be machined or blade cut with the aperture. Neodymium Iron Boron (NdFeB) or Samarium Cobalt (SmnCo5) are suitable materials for use with more compact switch designs that require a stronger magnetic holding force.

The magnetic armature 38 is attached to the bottom end of the post 32 with a fastener 40. The term fastener is intended to include any means for securing parts, including a bolt, screw, rivet, snap-fitting, weld, crimp, tab, or other means for fastening. The magnetic armature must be made from a magnetic material, but does not need to be electrically conductive. If the magnetic coupler 42 is bonded sheet magnet, a soft steel magnetic armature with a diameter of about 15 mm will require an actuation force of about half a Newton (actuation by a weight of 40 grams is preferred) to cause the magnetic armature to break away from the magnetic coupler. A flat steel washer is a suitable and very cost effective magnetic armature. To provide a uniform magnetic attractive force, the ideal shape for the magnetic armature is a flat disc with a centrally located hole 52 that the fastener passes through to hold the magnetic armature to the bottom end of the post The fastener should additionally have a fastener head 54 that protrudes from the bottom surface of the magnetic armature. A snap-fitting fastener that is an extension of the post, as shown in FIGS. 5 and 6, is preferred. A magnetic armature that has been secured to the bottom end of the post will be normally magnetically coupled to the bottom surface of the magnetic coupler.

In the preferred embodiment of the magnetically coupled pushbutton plunger switch of the present invention, the membrane switch assembly 44 uses a thin sheet of non-conductive material such as a polyester sheet that is about a tenth of a millimeter thick. Electrical conductors 56 and 58 and electrical leads (not shown) are printed or painted onto a surface of the thin sheet of non-conductive material, or membrane, and then the membrane is folded back onto itself so that there is a top membrane 60 and a bottom membrane 62 that are connected at the fold. The electrical conductor 56 on the top membrane 60 faces the electrical conductor 58 on the bottom membrane 62. The membrane includes a ribbon lead that is used to connect the electrical leads to an appropriate ribbon connector that extends from external electronics. The membrane switch assembly additionally includes a membrane shim 64, which is also a thin sheet of non-conductive material, which normally holds the electrical conductor 56 spaced out of electrical contact with the electrical conductor 58. There is an opening in the membrane shim that exposes the electrical conductors and defines a membrane switch cavity 66 that is substantially sealed from the surrounding environment.

The membrane switch assembly 44 is secured to a rigid platform 68 using spacer fasteners 70. The top surface of the rigid platform substantially supports the bottom membrane 62. The spacer fasteners also secure to the bottom of the base such that an armature cavity 72 is defined. To reduce the number of piece parts, the spacer fasteners may be molded into the base, as shown in FIGS. 5 and 6, or similarly molded into the rigid platform. The armature cavity houses the magnetic armature so that there is enough freedom of movement to allow the magnetic armature to travel downward for, preferably, about one millimeter.

During switch actuation, a user-provided actuation force 74 applied to the top of the hard keycap 30 causes the magnetic armature 38 to snap free of the magnetic coupler 42 so that the fastener head 54 travels into physical contact with the membrane switch assembly 44, as shown in FIG. 6. This physical contact causes the top membrane 60 to sufficiently deform into the membrane switch cavity 66 so that the electrical conductor 56 is forced into electrical contact with the electrical conductor 58. This electrical contact closes an electric circuit, thereby actuating the magnetically coupled pushbutton plunger switch Release of the user-provided actuation force allows the magnetic coupler to attract the magnetic armature back to a normal position, in coupled engagement with the magnetic coupler, so that the magnetic armature is spaced from the switch contacts. In this normal position, the fastener head does not physically contact and deform the top membrane, so the membrane switch returns to a normally open position.

In an alternative embodiment of the present invention, the hard keycap is not attached directly to the top end of the post. Instead, the hard keycap, or a functional equivalent that receives the user-provided actuation force, is attached to an arm that is capable of transferring force to the top end of the post. If desired, the arm may pivot about a fulcrum that is directly or indirectly supported by the base, rigid platform or other suitable structure, such that the direction of the user-provided actuation force can be changed into the necessary downward force required on the top end of the post during switch actuation.

In another alternative embodiment of the present invention, the armature and post are made from a single piece of magnetic material, such as sheet metal A piece of sheet metal is stamped, somewhat in the shape of a lollipop, so that it has a substantially round section and a substantially rectangular section that extends radially from the round section. The stamping should form cuts that impose the rectangular section at least to the center of the round section. The rectangular section may then be bent at about ninety degrees, perpendicular to the plane of the round section, so that it extends upwardly from substantially the center of the round section. The rectangular section takes the place of the post described above, and the round section functions as the magnetic armature. The top end of the rectangular section may include cuts that allow a hard keycap to snap-fit to the top end of this alternate post design. Also, it may be necessary to form a pip, or other protrusion, in the bottom of the round section to provide a functional equivalent of the fastener head already describe.

While a preferred form of the invention has been shown and described, it will be realized that alterations and modifications may be made thereto without departing from the scope of the following claims.

What is claimed is:

1. A method of making a magnetically coupled pushbutton plunger switch, comprising the steps of:

making a hard keycap and a post out of at least one substantially rigid material such that the hard keycap is attached to a top end of the post;

making a sleeve and a base out of at least one substantially rigid material such that the sleeve is attached to the base, the sleeve having a lumen;

forming a fastener with a fastener head;

forming a magnetic armature with a central hole;

forming a magnetic coupler with an aperture;

fixing the magnetic coupler to the base such that the aperture is substantially an extension of the lumen;

inserting at least part of the post into the lumen;

securing the magnetic armature to a bottom end of the post using the fastener such that the fastener head at least partially covers the central hole; and securing the base in spaced relation to a membrane switch assembly such that a user-provided actuation force, when applied against the hard keycap, causes the post to transfer sufficient force against the magnetic armature to cause the magnetic armature to break away from coupled engagement with the magnetic coupler until the fastener head physically contacts the membrane switch assembly, thereby closing the magnetically coupled pushbutton plunger switch.

2. The method of claim 1 wherein the step of making a hard keycap and a post is characterized by making a single piece-part that includes a bard keycap and a post.

3. The method of claim 2 wherein the steps of making a hard keycap and a post and forming a fastener with a fastener head are characterized by a making a single piece-part having a fastener formed on the bottom end of the post, the fastener having a fastener head that is slightly larger than the central hole, but the fastener head being deformable so that it can at least partially pass through the central hole.

4. The method of claim 1 further comprising the step of forming a keycap stop, on the top of the sleeve in a plane perpendicular to a length of the sleeve, that limits the downward travel of the hard keycap.

5. The method of claim 1 wherein the step of forming the magnetic coupler is characterized by making the magnetic coupler out of a permanent magnet material, and wherein the step of forming the magnetic armature is characterized by making the magnetic armature out of a material capable of being attracted by a permanent magnet.

6. The method of claim 1 wherein the step of forming the magnetic armature is characterized by making the magnetic armature out of a permanent magnet material, and wherein the step of forming the magnetic coupler is characterized by making the magnetic coupler out of a material capable of being attracted by a permanent magnet.

7. The method of claim 6 wherein the step of making the sleeve and the base is characterized by making at least the base from a material capable of being attracted by a magnet, and the step of forming the magnetic coupler with an aperture is characterized by defining a volume of the base that is to function as the magnetic coupler.

8. The method of claim 1 wherein the step of fixing the magnetic coupler to the base is characterized by insert molding at least the base to the magnetic coupler.

9. A magnetically coupled pushbutton plunger switch, comprising:

a post made from a substantially rigid material, the post having a top end and a bottom end;

a sleeve made from a substantially rigid material, the sleeve having a lumen in which the post is moveably mounted;

a base made from a substantially rigid material, the base being fixed to the sleeve;

a magnetic armature made from a magnetic material;

a magnetic coupler with an aperture, the magnetic coupler being fixed to the base such that the aperture is substantially an extension of the lumen;

a magnetic active force that normally holds the magnetic armature in coupled engagement with the magnetic coupler; and a membrane switch assembly that is secured in spaced relation to the base such that a user-provided actuation force, when directed against the top end of the post, transfers sufficient force against the magnetic armature to cause the magnetic armature to break away from coupled engagement with the magnetic coupler until the membrane switch assembly is physically forced to close electrical conductors of the magnetically coupled pushbutton plunger switch.

10. The switch of claim 9 further comprising a fastener with a fastener head for securing the magnetic armature to the bottom end of the post such that the fastener head at least partially protrudes from a bottom surface of the magnetic armature.

11. The switch of claim 10 wherein the fastener is a formed structure on the bottom end of the post, and the fastener head is capable of being deformed for the purpose of attaching the magnetic armature to the bottom end of the post.

12. The switch of claim 9 further comprising an arm that is capable of transferring the user-provided actuation force to the top end of the post.

13. The switch of claim 9 wherein the magnetic coupler is a permanent magnet material, and wherein the magnetic armature is made from a material capable of being attracted by a permanent magnet.

14. The switch of claim 13 wherein the post is rectangular section that is attached to the magnetic armature, but the post lies in plane that is substantially perpendicular to the plane of the magnetic armature.

15. The switch of claim 9 wherein the magnetic armature is a permanent magnet material, and wherein the magnetic coupler is made from a material capable of being attracted by a permanent magnet.

16. The switch of claim 9 wherein the magnetic armature is substantially a flat disc, and wherein the bottom end of the post is attached substantially to the center of the magnetic armature.

17. The switch of claim 9 wherein an insert molding process is used to fix the base to the magnetic coupler.

18. A magnetically coupled pushbutton plunger switch, comprising:

a post made from a substantially rigid material, the post having a top end and a bottom end;

a sleeve, made from a substantially rigid material, having a lumen in which the post is moveably mounted;

a keycap stop, on a top end of the sleeve, that limits the travel of the post;

a base that is fixed to the sleeve;

a magnetic armature with a central hole;

a magnetic coupler with an aperture, the magnetic coupler being a permanent magnet fixed to the base such that the aperture is substantially an extension of the lumen;

a fastener, with a fastener head, for securing the magnetic armature to the bottom end of the post such that the fastener head at least partially covers the central hole;

a magnetic attractive force that normally holds the magnetic armature in coupled engagement with the magnetic coupler;

a membrane switch assembly having printed or painted electrical conductors;

a rigid platform that substantially supports the membrane switch assembly; and a means for securing the rigid platform so that the membrane switch assembly is held in spaced relation to the base such that a user-provided actuation force, when applied substantially against the top end of the post, causes the magnetic armature to break away from coupled engagement with the magnetic coupler until the fastener head physically contacts the membrane switch assembly, thereby closing the electrical conductors of the membrane switch assembly.

19. The switch of claim 18 further comprising an arm that substantially transfers the user-provided actuation force to the top end of the post.

20. The switch of claim 18 further comprising a hard keycap formed on the top end of the post.

* * * * *